US005394932A

United States Patent [19]

Carozza et al.

[11] Patent Number: 5,394,932

[45] Date of Patent: Mar. 7, 1995

[54] MULTIPLE PART CORES FOR INVESTMENT CASTING

[75] Inventors: Eugene J. Carozza, Wilton, Conn.; Gregory R. Frank, Muskegon, Mich.; Charles F. Caccavale, Wharton; Ronald R. Robb, Randolph, both of N.J.

[73] Assignee: Howmet Corporation, Greenwich, Conn.

[21] Appl. No.: 831,528

[22] Filed: Feb. 5, 1992

Related U.S. Application Data

[63] Continuation-in-part of Ser. No. 821,817, Jan. 17, 1992, abandoned.

[51] Int. Cl.[6] ..... B22C 9/10

[52] U.S. Cl. ..... 164/137; 164/15; 164/369; 164/529

[58] Field of Search ..... 164/369, 370, 361, 137, 164/529, 15

[56] References Cited

U.S. PATENT DOCUMENTS

| | | | |
|---|---|---|---|
| Re. 31,488 | 1/1984 | Trumbauer . | |
| 3,234,308 | 2/1966 | Herrmann . | |
| 3,433,282 | 3/1969 | Crocker et al. . | |
| 3,654,987 | 4/1972 | Wittmoser et al. . | |
| 3,756,309 | 9/1973 | Nishiyama et al. | 164/369 X |
| 3,868,990 | 3/1975 | Grawey . | |
| 3,957,715 | 5/1976 | Lirones et al. . | |
| 3,964,534 | 6/1976 | Rabinowitz . | |
| 4,093,017 | 6/1978 | Miller, Jr. et al. | 164/369 X |
| 4,093,018 | 6/1978 | Trumbauer . | |
| 4,187,266 | 2/1980 | Greskovich et al. . | |
| 4,191,720 | 3/1980 | Pasco et al. . | |
| 4,191,721 | 3/1980 | Pasco et al. . | |
| 4,221,748 | 9/1980 | Pasco et al. . | |
| 4,252,175 | 2/1981 | Whipple . | |
| 4,265,665 | 5/1981 | Bedell . | |
| 4,328,854 | 5/1982 | Gartner et al. . | |
| 4,413,666 | 11/1983 | Page . | |
| 4,427,742 | 1/1984 | Willgoose et al. . | |
| 4,532,974 | 8/1985 | Mills et al. . | |
| 4,596,281 | 6/1986 | Bishop | 164/369 X |
| 4,767,479 | 8/1988 | Ferguson et al. . | |
| 4,837,187 | 6/1989 | Frank et al. . | |

FOREIGN PATENT DOCUMENTS

| | | | |
|---|---|---|---|
| 0397481 | 11/1990 | European Pat. Off. | 164/137 |
| 59-50080 | 3/1984 | Japan | 164/369 |
| 62-34647 | 2/1987 | Japan | 164/137 |
| 62-176636 | 8/1987 | Japan | 164/369 |
| 2-280945 | 11/1990 | Japan | 164/137 |

*Primary Examiner*—David Brown

*Attorney, Agent, or Firm*—Finnegan, Henderson, Farabow, Garrett & Dunner

[57] ABSTRACT

A composite core for a hollow gas turbine engine blade is constructed by forming a first core part determinative of the cavity size of the trailing edge blade portion from a first ceramic material and joined to a second core part determinative of the blade cavity for the blade body portion which is formed from a second ceramic material. The first and second ceramic materials can be chosen to have appropriate characteristics grain sizes, flowability, leachability, and/or reactivity characteristics taking into consideration the different dimensional restrictions imposed by the desired blade product. A tongue is formed on the adjoining edge surface of the trailing edge core part, and the trailing edge core part is then inserted into a second die and the body core part is formed, including a complementary groove member which is formed around the tongue member on the trailing edge core part. The joined trailing edge and body core parts can then be sintered to form a composite casting core.

40 Claims, 3 Drawing Sheets

MULTIPLE PART CORES FOR INVESTMENT CASTING

This application is a continuation-in-part of application Ser. No. 07/821,817, filed Jan. 17, 1992, on behalf of the same inventors and now abandoned.

BACKGROUND OF THE INVENTION

FIELD OF THE INVENTION

The present invention pertains to multiple part cores for investment castings, and particularly to multiple part cores for hollow gas turbine engine blade castings, and methods for preparing such multiple part cores.

DISCUSSION OF THE RELATED ART

Turbine blades for high performance gas turbine engines are generally required to have an internal cavity to provide a conduit for cooling air supplied to holes and slots distributed about the blades. Without such, the blades would not be able to operate in the high temperature environment where temperatures on the order of 2,800° F. are commonplace, even when the blades are formed from modern, high temperature resistant superalloys such a the new "reactive" superalloys which have recently shown substantial benefits for advanced, single crystal gas turbine engine blade applications. See U.S. Pat. No. 4,719,080 (Duhl). As a consequence, conventional blade forming processes and apparatus use a separate core part for investment casting such blades, with the separate core part determining the internal cavity dimensions of the cast blade. Various core materials and core forming techniques are known in the art, and such are described, e.g., in U.S. Pat. No. 4,191,720 (Pasco et al.) and U.S. Pat. No. 4,532,974 (Mills et al.).

FIG. 1 shows a conventional one piece core for forming the internal cavity of a gas turbine engine blade and designated generally by the numeral 10. Core 10 has a portion 10*a* which determines the cavity dimensions in the "leading edge" portion of the cast blade, and a portion 10*b* determines the shape of its cavity in the "trailing edge" blade portion. In the core pictured in FIG. 1, the edge 13 of core portion 10*b* also determines the shape of the trailing edge slot of the cast blade. FIG. 2B represents schematically edge 13 of core 10 determinative of the trailing edge slot of the gas turbine blade and having a thickness dimension $H_0$.

In operation of the gas turbine, it is important to accurately control the cooling air flow to various blade parts. Insufficient flow can result in "hot spots" leading to the possibility of early blade failure, and excess flow decreases the thermal performance of the engine. In general, it is advantageous to produce blades having the smallest trailing edge slot thickness that can be reliably and accurately maintained. In an effort to better control the cooling air flow out of the cast blade trailing edge slot and to increase the heat transferred to the cooling air, conventional cores are provided with an array of through-holes to allow the formation of pedestals in the cast product. The pedestals reinforce the trailing edge and shows such an array of pedestal-forming through-holes 20 having a pitch spacing $S_0$.

To mold a complex ceramic core design similar to the one depicted in FIG. 1, the ceramic core molding material must first enter the mold cavity, fill the zones of least resistance, and then proceed to fill the zones of greatest resistance to flow. Those zones of greatest resistance to flow typically are those of the smallest cross sectional dimensions or those which possess a high surface area to volume ratio (i.e., long, thin trailing edge exits).

Ceramic core compositions utilizing thermoplastic binder materials such as those typically used in injection molding processes tend to resist flow and even solidify rapidly in constricted zones of core dies. If the runner feeding system does not solidify, the material pressure within the cavity builds to the hydraulic pressure applied on the material at the nozzle of the press. However, it has been a typical experience of injection molders that even when the maximum pressure is applied, the core die does not completely fill to form an acceptable article. This is especially true when attempting to produce cores with thin trailing edge exits. These exits are areas where the die surface area to mold volume aspect ratio is unfavorable from a heat transfer and flow standpoint. Consequently, conventional cores and core forming techniques result in blade products having minimum inches and minimum pedestal pitch spacing of greater than about 0.015 inches, on a commercially practicable basis.

Also, conventional one piece cores made by the various core manufacturing processes such as transfer molding and injection molding require relatively complex "multi-pull" dies of the oblique relationship between the axes of the pedestal-forming through-holes located near the trailing edge forming core portion and other through-holes proximate the leading edge core portion, such as the rib forming holes 20 in FIG. 1. This oblique relationship is due to blade (and thus core) curvature. Such complex dies can be quite costly and also can complicate the molding procedure.

SUMMARY OF THE INVENTION

As a consequence of the foregoing, it is an object of the present invention to provide an improved core for investment casting of hollow products such as gas turbine blades, which hollow products have varying cavity dimensions including relatively narrow cavity portions, with good dimensional control.

It is a further object of the present invention to achieve cores for use in investment casting gas turbine blades of the type having a trailing edge slot and pedestal-forming through-holes wherein the resulting cast blade trailing edge slot thickness dimension and pedestal pitch spacing can be significantly reduced from the minimum dimensions currently available from conventional cores and core forming processes.

It is still a further object of the present invention to produce alumina-based cores capable of achieving cast blade trailing edge slot thicknesses of less than or equal to about 0.015 inches for use with the new "reactive" superalloys.

It is yet a further object of the present invention to provide cores and methods for forming the cores that will enable the use of "single-pull" type dies in the molding process to achieve cores yielding cast gas turbine blade products having good internal cavity dimension control, particularly in the minimum cavity dimension portions of the blade.

In accordance with the present invention, as embodied and broadly described herein, the composite casting core for a hollow product having a portion with a small cavity size relative to another product portion comprises a first core part determinative of the cavity size of the small cavity product portion and formed from a first ceramic material. The composite core further comprises a second core part determinative of the cavity size of the other product portion formed from a second ceramic material and Joined to the first core part.

In one preferred embodiment, the second ceramic material has a characteristic grain size greater than that of the first ceramic material. In another preferred embodiment, the first ceramic material has a different thermal, reactivity, leachability, and/or flowability characteristic relative to embodiment, both the first and second ceramic materials are selected to be highly resistant to reaction with rare earth-containing superalloy casting materials.

Preferably, the product is a hollow, gas-cooled gas engine turbine blade having a trailing edge portion and a body portion. The first core part is determinative of the cavity size and shape of the blade trailing edge portion, and the second core part is determinative of the cavity size and shape of the blade body portion. When used herein in conjunction with the description of the present invention, the term "blades" is intended to encompass both gas turbine engine rotating blades and stationary vanes as well as other relatively thin airfoil-shaped engine structures.

It is also preferred that the composite casting core further include interlocking means for mechanically joining the first core part and the second core part. The first core part and the second core part have respective surfaces at which the parts are joined, and complementary interlocking members, such as a tongue and a groove, are provided on the respective joining surfaces to provide the interlocking means.

Further in accordance with the present invention, as embodied and broadly described herein, the method for forming a casting core for a hollow product having a portion with a small cavity size relative to the other product portions cavity product portion from a first ceramic material; forming a second core part determinative of the cavity size and shape of the other product portions from a second ceramic material; and mechanically joining the first and second core parts to provide a composite casting core.

In a preferred embodiment, the process includes the preliminary step of selecting the second ceramic material to have a grain size greater than that of the first ceramic material. In another preferred embodiment the process includes the step of selecting a first ceramic material having different thermal, leachability, reactivity, and/or flow characteristics relative to the second ceramic material.

Preferably, the first and second core parts are joined at respective joining surfaces, and the first core part forming step includes the step of forming one of a pair of complementary interlocking members on the joining surface associated with the first core part. The second core part forming step includes the step of forming the other of the interlocking member pair on the joining surface associated with the second core part.

It is further preferred that the second core part forming step includes the steps of inserting into a die a previously formed first core part including a first core part joining surface having one of a pair of complementary interlocking elements; and flowing the second ceramic material into the die to contact and surround the first core interlocking element is formed concurrently with the second core part, and whereby the first core part and the second core part are concurrently joined together in a manner to achieve dimensional control and reproducibility.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

Of The Drawings.

DESCRIPTION OF THE PREFERRED EMBODIMENTS

Reference will now be made to the present preferred embodiment of the invention which is illustrated in the accompanying drawing as described above.

Figure 1:
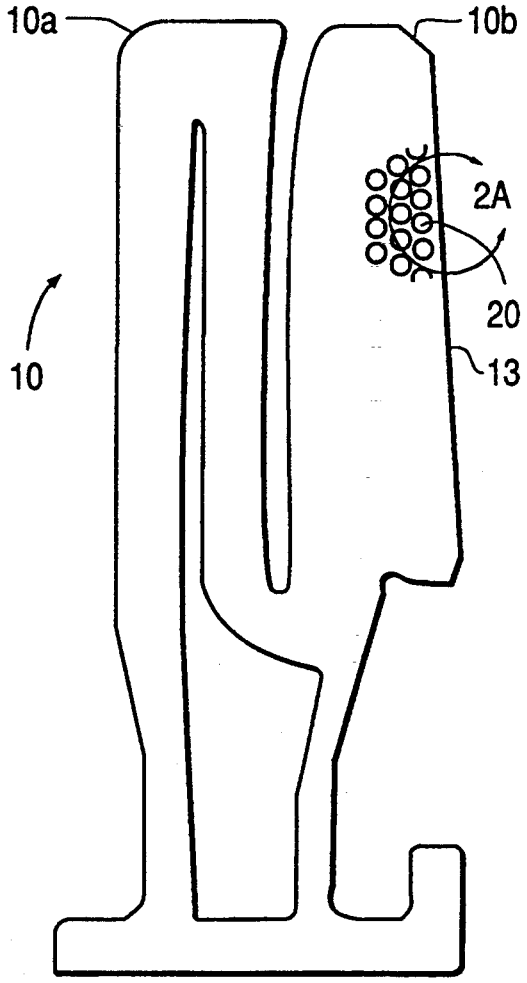
FIG. 1 (PRIOR ART)
FIG. 1 is a schematic view of a conventional gas turbine engine blade casting core.
Figure 2A:
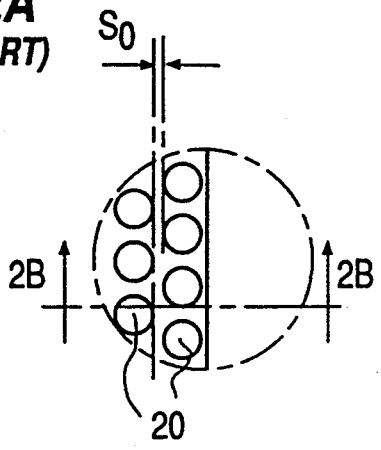
FIG. 2A (PRIOR ART)
FIGS. 2A and 2B are a detail of the conventional core pictured in FIG. 1 and a partial cross section of the core pictured in FIG. 1 taken along the line 2B—2B, respectively.
Figure 2B:
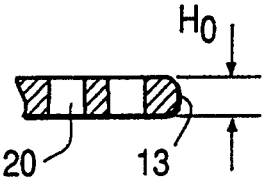
FIG. 2B (PRIOR ART)
Figure 3:
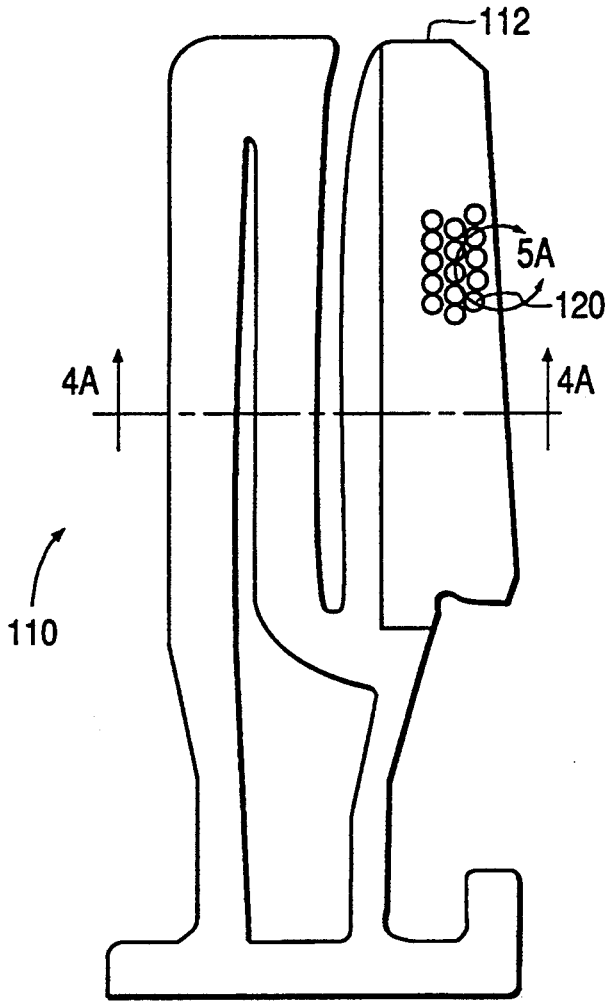
FIG. 3 is a schematic side view of a composite casting core for a gas turbine engine blade made in accordance with the present invention.

With reference initially to FIG. 3, there is shown schematically a hollow gas turbine engine blade casting core made in accordance with the present invention and designated by the numeral 110. Where applicable in the succeeding discussion, identical reference numbers, but with a "100" prefix, will be used to designate like parts relative to the conventional gas turbine blade casting core depicted in FIGS. 1, 2A and 2B, and discussed previously.

In accordance with the present invention, the composite casting core for a hollow product having a portion with a small cavity size relative to other product portions includes a first core part determinative of the cavity size and shape of the small cavity product portion and formed from a first ceramic material. As embodied herein, and with continued reference to FIG. 3, the gas turbine blade composite casting core 110 which is determinative of the cavity of the cast gas turbine blade (not shown) includes first and second core parts 112 and 114 joined along respective abutting edge surfaces 116 and 118 by means which will be discussed in more detail hereinafter. Core part 112 is determinative of the product which, typically, has the smallest cavity size (thickness). Core part 114 is determinative of the larger cavity size or "body" portion of the blade.

While the preferred embodiment of the present invention is discussed in terms of a two-part gas turbine blade casting core, the present invention is not so restricted. Blade casting cores of three or more parts as well as non-blade casting products are deemed to come within the broad aspects of the present invention which is to be limited solely by the appended claims and their equivalents.

Figure 5A:
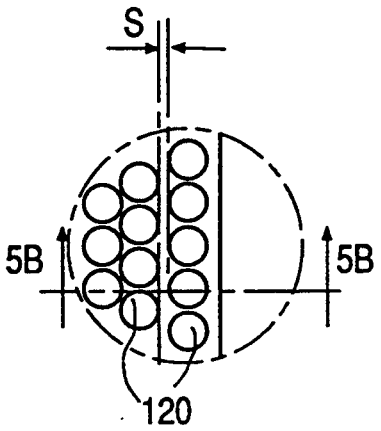
FIGS. 5A and 5B are a detail of the composite core illustrated in FIG. 3 and a partial cross section of the composite core illustrated in FIG. 3 and taken along the line
Figure 5B:
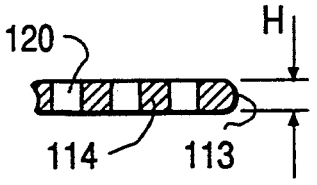
Figure 4A:
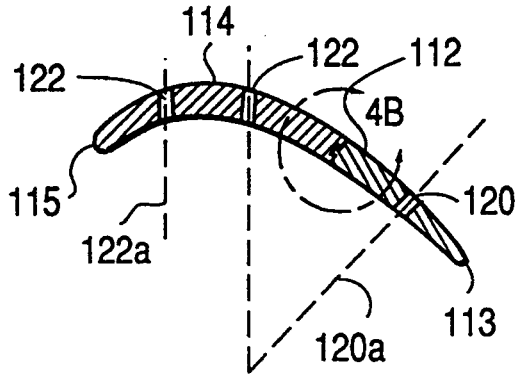
FIGS. 4A is a cross section taken along the line 4A—4A of the gas turbine blade casting core illustrated in FIG. 3.

As can best be seen in the cross section of FIG. 4A, the core trailing edge part 112 is curvilinear and tapers in thickness from abutting edge surface 116 to the tip 113 which is determinative of the trailing edge slot size of the final gas turbine engine blade product. See FIG. 5B which depicts a tip 113 with a thickness dimension H. Core part 112 further contains a plurality of through-holes 120. Holes 120 provide in the cast blade product, pedestals bridging the blade cavity in the trailing edge portion. The pedestals serve to limit the cooling gas flow rate out of the trailing edge slot and provide increased blade rigidity and internal heat transfer surface area, as explained previously.

Significantly, the present invention has enabled through-holes to be spaced to provide in the cast blade, pedestals spaced at a pitch as small as about 0.015 inches or less, thereby providing greater cooling gas flow control. Also, the invention has provided tip portion 113 of core part 112 that can yield cast blade trailing edge slot thicknesses as small as about 0.007–0.010 inches, a result which further improves the ability to control the cooling gas flow rate through the hollow blade.

Casting core materials, including those of the present invention, can experience changes in dimensions (shrinkage) both during sintering and during casting of the blade, as a consequence of the coalescing of the material and possible "burning off" of binder materials. Therefore, a finished blade trailing edge slot thicknesses of 0.007 inches does not necessarily mean that the core tip thickness is 0.007 inches, nor does a pedestal pitch spacing of 0.015 inches necessarily equate to a 0.015 inch spacing of through-holes 120 in core part 112. However, using conventional design and test practices, those skilled in the art would be able to achieve desired blade dimensions given the teachings of the present disclosure without undo experimentation. Also, blade casting cores made in accordance with the present invention can have configurations without through-holes or with different shaped holes.

The ceramic casting material utilized for core part 112 is selected to have good leachability characteristics and, importantly, to have a small enough grain size to allow all parts of the mold to be filled during forming of core part 112 and also flushing from the small cavity portion of the blade during the leaching operation. For the composite core pictured in FIG. 3, a mixture of silica, zircon and alumina in proportions of about 84 wt %/10 wt %/6 wt % and having an average grain size of about 120–325 mesh was found to be suitable for one embodiment of the present invention. Silicone resin was found to be suitable as a binder for transfer molding the above composition. Other ceramic materials that may be suitable for use in forming a core part 112, that is, the core part determinative of the cavity in the trailing edge blade portion, are alumina, zircon, silica, yttria, magnesia and mixtures thereof. However, certain of these such as alumina and zircon are more difficult to leach than silica but may have other favorable properties such as flowability, low cost, and reduced reactivity with the metal alloy materials used for the castings. A particular family of materials which may be preferred in embodiments where one or both core parts 112 and 114 are formed by low pressure injection molding is described in U.S. Pat. No. 4,837,187 the disclosure of which is hereby incorporated by reference.

In accordance with the present invention, the composite casting core further includes a second core part determinative of the cavity size of another product portion, formed from a second ceramic material, and joined to the first core part. As embodied herein, and with continued reference to FIG. 3, core part 114 is determinative of the cavity size of the body portion of the gas turbine blade. Core part 114 also is curvilinear and tapers from a leading edge 115 to the respective abutting edge surface 118 to accommodate, in combination with the trailing edge core part 112, the desired aerodynamic blade shape as would be appreciated by those skilled in the art. See FIGS. 4A and 4B. Core portion 114 also includes through-holes 122 which are intended to provide in the cast blade body cavity, longitudinally extending ribs. As can be appreciated from the FIG. 4A cross section, the axes 120*a* and 122*a* of through-holes 120 and 122, respectively, are oblique as a consequence of the curvature of the composite casting core 110.

In a first preferred embodiment of the present invention, body core part 114 is formed from a ceramic material having a larger characteristic grain size compared to the grain size of the material used for core part 112, in order to increase stability and resistance to deformation. For conventional, one piece core constructions, using a ceramic material with a "fine" grain size suitable for trailing edge part 112 in body core part 114 can yield a core subject to unacceptable shrinkage and distortion during sintering. Consequently, in the first preferred embodiment of the present invention a larger grain size ceramic material is used for body core part 114. Because of the relatively larger cavity size dimensions in the finished cast gas turbine blade body portion, ceramic materials having less favorable leaching characteristics but potentially superior molding, low reactivity, or cost characteristics can be utilized for core part 114. A material suitable for core part 114 in the first preferred embodiment was found to be alumina having a grain size of 120 mesh (−50/+100) and a silicon resin binder was used in a transfer molding process. Trailing edge slot thicknesses of less than or equal to 0.015 inches, and even less than or equal to 0.010 inches, namely about 0.008", or less have been obtained with the first embodiment using transfer molding techniques.

While alumina was found to be preferable in the construction of body part 114 of the composite casting core 110 pictured in FIG. 3 in accordance with the first embodiment, silica and zircon could be used for forming core part 114, as well as mixtures of silica, zircon and alumina. In general, for the first preferred embodiment, the ceramic material used for body core part 114 can be the same or different from that used for the trailing edge core part 112 but the characteristic grain sizes are chosen to be different to reflect the casting conditions imposed by the specific core parts.

The term "larger characteristic grain size" is not to be interpreted to mean that all the grains have the same size or that all grains are larger than the grains of the comparative, first ceramic material. As one skilled in the art would realize, standard techniques such as sieving used to classify granular products will yield a distribution of grain sizes for the material between two successive sieve sizes. Also, commercially practicable processes often result in incomplete classification such that smaller grain sizes can appear in a fraction, which smaller sizes would not be expected if complete sieving were possible. Hence, the term "larger characteristic grain size" is to be taken to mean that, on average, the grains of that material have a larger characteristic dimension relative to the material to which it is being compared.

In a second preferred embodiment of the present invention, the characteristic grain sizes of the ceramic materials need not be meaningfully different. Rather, different materials are chosen for forming core parts 112 and 114 based on one or more of the other important factors such as thermal characteristics, leachability, moldability, low reactivity, cost, etc. For example, a silica or silica-based ceramic material may advantageously be used for core part 112 having the smallest dimensions because, in general, it will leach at a higher rate than alumina or an alumina-based ceramic. Concurrent with the use of the silica based ceramic for core part 112, an alumina or alumina-based ceramic material can be used for core part 114 where the larger cast blade internal dimensions would tend to allow removal of a material having less favorable leaching characteristics in a commercially reasonable time.

One of the surprising results attributable to the present invention is the ability to use ceramic materials with different thermal characteristics (e.g..., thermal coefficient of expansion) successfully in combination to provide a composite core for casting a hollow gas turbine engine blade. For example, at 1000° C. the thermal coefficient of expansion of a fired alumina product is about eight (8) times that of a fired fused silica product.

In yet a third preferred embodiment of the present multipart core invention, essentially no difference exists in the composition or the characteristic grain sizes of the materials used for core parts 112 and 114 of gas turbine engine blade core 110. Rather, the two piece core construction itself has been found to provide surprising benefits in terms of improved blade core dimensional control and reproducibility, particularly in the critical trailing edge portion.

A particular class of ceramic materials, namely materials of the type described in U.S. Pat. No. 4,837,187, has been found to be advantageous for use in forming both core parts 112 and 114 of gas turbine engine blade core 110 by low pressure injection molding. Specifically, a material with a composition of about 84.5 wt % alumina, 7.0 wt % yttria, 1.9 wt % magnesia, with 6.6 wt % graphite (flour), was found to perform acceptably in a two piece core construction as depicted schematically e.g., in FIG. 3. The alumina component included 70.2% of 37 μm sized grains, 11.3% of 5 μm grains, and 3% of 0.7 μm grains. The grain sizes of the other components were: graphite - 17.5 μm; yttria - 4 μm; and magnesia - 4 μm. The thermoplastic binder used included the following components (wt % of mixture): Okerin 1865Q (Astor Chemical); paraffin based wax 14.41 wt %; DuPont Elvax 310 FINNECAN, 0.49 wt %; oleic acid - 0.59 wt %.. Other ceramic material components and thermoplastic binders could be used, including those set forth in U.S. Pat. No. 4,837,187.

While having an appropriate "fineness" to achieve acceptable minimum trailing edge slot dimensions of about 0.007–0.010 inches, the above material was also found to have adequate leaching characteristics and, importantly, sufficient dimensional stability during handling and firing to perform satisfactorily in core part 114. The above-identified material has the additional advantage of being relatively non-reactive to certain rare earth containing superalloys used in casting high performance gas turbine engine blades, and thus could be preferred for such applications.

By having one common material for both core components, a common shrink factor can be applied. Cracking due to differential shrinkage rates through core sintering is less likely when all portions of the core are made of one material versus different materials. The mismatch in thermal expansion that can occur with different materials being joined together can lead to cracking at the joined area. This would not be the case with cores entirely composed of one material. In addition, the joint may also crack if cores of multiple materials are thermally processed and the adjoining materials possess different thermal expansion rates and/or overall final shrinkage values. This would not be expected in cores made of entirely one material.

Significantly, all three of the presently preferred embodiments provide advantages in fabricating products such as gas turbine engine blades having cavities or through-holes with non-parallel axes as will be discussed in more detail hereinafter.

In accordance with the present invention, means are provided for joining the core parts. As embodied herein, the means for joining core parts 112 and 114 can include complementary interlocking members such as tongue member 124 formed along edge surface 116 of trailing edge core part 112, and complementary groove member 126 formed in edge surface 118 of core body part 114. Groove member 126 interlocks with tongue member 124 to hold core parts 112 and 114 together in the "green body" state and also in the sintered state. The interlocking is accentuated by forming tongue member 124 with a diverging tip for positive capture by groove member 126. See FIG. 4B.

Other joining means including other complementary interlocking-type joining means and configurations can be utilized, as one skilled in the art would appreciate from the present disclosure. Mechanical joining means not requiring complementary interlocking members can be used in the present invention particularly if the thermal characteristics of the materials used for the core parts are not appreciably different. As used herein, the term "mechanical joining means" can include a thermal bond between the core parts, such as by heating core parts having thermoplastic binder materials, as contrasted with a chemical bond resulting from the use of adhesives or solvents. However, the depicted tongue and groove configuration is presently preferred for the embodiments described above having core parts with differing thermal characteristics because core parts 112 and 114 are interlocked along substantially the entire length of edge surfaces 116 and 118, thereby providing increased resistance to warping and cracking of the parts, better dimensional control, and increased reproducibility.

Figure 6:
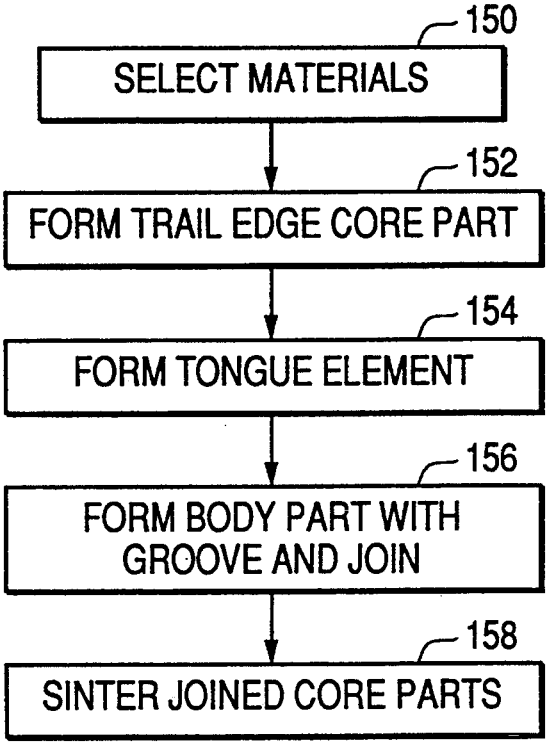
FIG. 6 is a schematic illustrating the process used to manufacture the composite core illustrated in FIG. 3.

In accordance with the present invention, the method for forming a casting core for a hollow product having a portion with a small cavity size relative to that of another product portion includes the step of forming a first core part determinative of the cavity size of the small cavity product portion from a first ceramic material. As embodied herein, and with respect to the FIG. 6 schematic, step 152 includes forming the trailing edge core portion 112 in the FIG. 3 embodiment from a first ceramic material. The method also includes the preliminary step 150 of selecting the respective ceramic materials, particularly selecting a ceramic material for trailing edge core part 112. The selection of the grain size for the first ceramic material should be made in accordance with the minimum cavity dimension, and the material should have the requisite flow, leaching, etc. properties, in order to provide a commercially practicable operation.

Preferably, step 152 of forming the trailing edge core portion 112 is accomplished in a single pull die whenever axes 120*a* of holes 120 are all parallel to one another. The selected ceramic material such as the silica/-zircon mix and binder are densified in the die (not shown) to form a green body with sufficient density and integrity to allow further handling outside of the die. For good release properties and long life, the dies can be chrome plated.

As embodied herein, the next step 154 in the process includes forming a complementary interlocking member such as tongue member 124 on edge surface 116 of core part 112 if such members are to be used to facilitate the mechanical joining. This can be accomplished by machining the formed core part 112 but can alternatively be done concurrently with the core part 112 forming step 152 if a suitable die is constructed. The latter alternative would greatly reduce manufacturing time but would increase the complexity and, possibly, the cost of the die.

In accordance with the present invention, the method further includes the step of forming a second core part determinative of the cavity size of the other, larger cavity product portion from a second ceramic material. The second core part forming step can also include a preliminary step of selecting a suitable ceramic material in accordance with the larger dimensions of the core part, such as core part 114 of the disclosed embodiment. As discussed previously the second ceramic material can be selected to have a larger characteristic grain size and/or less favorable leaching or flow characteristics but with offsetting benefits such as increased dimensional stability, decreased reactivity, etc.

Figure 4B:
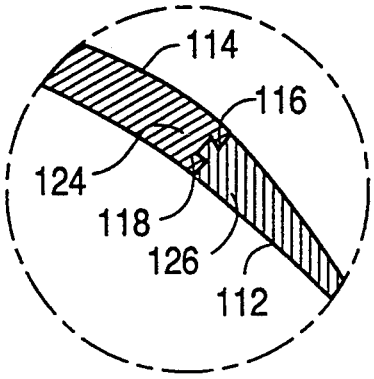
FIG. 4B is a detail of the section.

As embodied herein, the method includes the step 156 of forming core body part 114 by inserting the preformed core trailing edge part 112 in a second die and loading the second ceramic material into the remaining second die space. The second ceramic material should have adequate flow properties such that the material contacts the full extent of abutting edge surface 116 of core part 112. For core constructions using complementary interlocking means such as depicted in FIG. 4A and 4B, the second ceramic material flows around all sides of tongue member 124 to form the capture groove member 126. Hence, the body core part forming step can be performed simultaneously with the step of joining core parts 112 and 114.

While in certain applications it may useful to form core body part 112 and groove member 126 separately and then join them using prior to sintering, use of complementary interlocking-type joining members makes the above-discussed simultaneous forming and joining step clearly preferred. Importantly, because core trailing edge part 112 with through-holes 120 has previously been formed, a less expensive single pull die can be used for forming body core part 114 with through-holes 122.

As further embodied herein, the method includes the step 158 of sintering the joined core. This can be accomplished using techniques and apparatus familiar to those skilled in the art and can include the use of core setters or other green body support members to ensure retention of the desired shape and prevent longitudinal warping.

Various molding techniques such as transfer molding, injection molding, poured core techniques, and combinations thereof can be used to carry out the processes and form the multipart cores of the present invention. Generally the use of "coarser" grain sizes or materials having less favorable flow properties may dictate the use of transfer molding to form the core parts 114. However, transfer molding can be used for core part 112 as well, and injection molding could be used for both core parts 112 and 114 depending upon the materials chosen.

The particular alumina-yttria-based ceramic material mentioned previously has been found to perform acceptably in injection molding apparatus. In the two part injection molding operation in accordance with the present invention, a separate core die is used to mold the trailing edge portion of the desired core. By molding the trailing edge portion separately from the main body of the core, maximum hydraulic pressure can be applied to the trailing edge exit and in an extremely short amount of time, thus permitting the complete fill of this area of fine detail. The trailing edge core part is subsequently removed from the core die in which it was formed and transferred to the main body core die. Select details on the trailing edge core fit or lock into matching details in the main body core die in order to align the trailing edge core part during the subsequent molding of the main body core. After the green (unfired) trailing edge core part has been properly positioned in the main core die blocks, the main die blocks seat together and molten core material is then introduced into the cavity.

In low pressure injection molding, it is the incoming material's temperature coupled with the associated injection pressure (on the order of 500–3000 psi) which causes the main body part to "bond" to the trailing edge as a result of a partial re-melting of the joining surface portion of the trailing edge core part. Typically, in injection molding a wax-type binder is used which is thermoplastic and has a lower melting temperature than the thermosetting binder materials used in transfer molding. After the appropriate press cycle time to cure the main core body has been completed, the core die opens and the composite core is removed from the tool by means familiar to those skilled in the art. By using this technique with steel dies, alumina based cores of significant complexity have been molded and fired possessing trailing edge exit thicknesses to achieve cast blade slot thicknesses on the order of 0.007–0.010 inches.

Table 1 compares transfer and injection molding techniques as they might be used to form two-part gas turbine blade cores of the type shown in FIG. 3:

TABLE I

| ITEM | INJECTION MOLDING (LOW PRESSURE) | TRANSFER MOLDING |
|---|---|---|
| A. MATERIALS | | |
| Ceramic material | Alumina + yttria + magnesia | Fused silica + zircon + cristobalite |

TABLE I-continued

| ITEM | INJECTION MOLDING (LOW PRESSURE) | TRANSFER MOLDING |
|---|---|---|
| Binder system | Themoplastic (i.e., wax based) | Thermoset (i.e. silicone based) |
| Particle size distribution | The same "fine" grain material is used for both the leading and trailing edge core portions. | Body portion: A "coarse" grain fomulation is Trailing edge portion: A "fine" grain formulation is used. |
| B. PROCESSING | | |
| Die Temperature (typical) | 75° F.–85° F. | 350° F.–450° F. |
| Press dwell time (typical) | 15 seconds–30 seconds | 60 seconds–120 seconds |
| Press scrap revertability | Revertible (i.e. can remelt) | Non-revertible |
| Prebake cycle required | Yes | Sometimes (part cross section dependent) |
| Firing temperature | 3050° F. | 2050°. |
| Firing time | 48 hours | 48 hours |
| Core Finishing | Must be finished after firing | Can be finished either before or after firing |

The materials and processing parameters set forth in Table I are deemed to be exemplary only and are not to be construed to limit the scope of the present invention as determined by the appended claims and their equivalents.

Several benefits can be derived from two part core injection molding in accordance with the process of the present invention versus cores manufactured using traditional one piece core dies:

1. The two part core injection molding technique permits the injection molding material to impact the trailing edge area quickly under high pressure. This greatly assists filling extremely thin exit details. In conventional one piece multiple plane injection molding core dies, the paths of least resistance (i.e., serpentine areas of greater crosssection) fill first, and the material can cool, solidify and block flow passages before back pressure can be applied to fill the thin exits.
2. The tooling costs with the double injection method would be lower than that for multiple plane dies, as two single plane dies would typically cost less than one multiple plane die. In addition, tooling lead times would be reduced, as single plane dies can typically be constructed in less time than multiple plane dies. Also, reduced parting lines in the cast blade product and increased die life can result. These benefits also accrue to two part core transfer mold dies.
3. Improved dimensional control is possible with the two piece method because the trailing edge inserts on multiple plane dies need constant adjustment and maintenance in order to maintain the desired trailing edge thickness. Single plane dies possess no moving trailing edge die slides characteristic of high camber multiple plane dies. In addition, the press clamp pressure is more transverse to the parting line of a single plane die. This is beneficial in holding thickness dimensions in the green core. Again, this benefit can also be obtained using transfer molding dies.

It will be apparent to those skilled in the art that various modifications and variations can be made in the above-described embodiments of the present invention without departing from the scope or spirit of the invention. Thus, it is intended that the present invention cover such modifications and variations provided they come within the scope of the appended claims and their equivalents.

What is claimed is:

1. Composite core for casting a hollow product having a portion with a small cavity size relative to that of another product portion, the core comprising:

a first core part determinative of the cavity size and shape of the small cavity product portion and formed from a first ceramic material having a characteristic grain size; and a second core part determinative of the cavity size and shape of the other product portion, formed from a second ceramic material, and joined to said first core part, said second ceramic material having a characteristic grain size greater than that of said first ceramic material.

2. The composite casting core as in claim 1, wherein each of said first core part and said second core part has at least one through-hole having a corresponding axis, and wherein the axes of said respective through-holes are nonparallel.

3. The composite casting core as in claim 1, wherein said joined first core part and said second core part are sintered.

4. The composite casting core as in claim 1, further including complementary interlocking means for mechanically joining said first core part and said second core part.

5. The composite casting core as in claim 4, wherein said first core part and said second core part have respective surfaces at which the parts are joined, and wherein a tongue and a complementary groove are provided on said respective joining surfaces.

6. The composite casting core as in claim 1 wherein the product is a hollow, gas-cooled gas engine turbine blade having a trailing edge portion and a body portion, and wherein said first core part is determinative of the cavity size and shape of said trailing edge portion, and the second core part is determinative of the cavity size and shape of said body portion.

7. The composite casting core as in claim 6, wherein the first and second ceramic materials are selected from the group consisting of silica, zircon, alumina, and mixtures thereof.

8. The composite casting core as in claim 6, wherein said first ceramic material is predominantly silica.

9. The composite casting core as in claim 6, wherein said second ceramic material is predominantly alumina.

10. The composite casting core as in claim 6, wherein said first ceramic material consists essentially of a mixture of silica and zircon and has a characteristic grain size of about 120–325 mesh, the weight percent of silica in the mixture comprising said first ceramic material being greater than about 80%, and wherein said second ceramic material is alumina having a characteristic grain size of about 120 mesh (−50/+100).

11. The composite casting core as in claim 2, for use in a blade having a trailing edge slot, wherein the thickness of the portion of the first core part corresponding to the slot provides a cast blade trailing edge slot thickness of about 0.015 inches or less.

12. The composite casting core as in claim 2, wherein said first core part includes an array of through-holes for forming pedestals inside the cast hollow blade, the through-holes being spaced to provide a pedestal spacing in the cast blade having a pitch of about 0.015 inches or less.

13. Composite casting core for a hollow product having a portion with a small cavity size relative to that of another product portion, the core comprising:

a first core part determinative of the cavity size and shape of the small cavity product: portion and formed from a first ceramic material;

a second core part determinative of the cavity size and shape of the other product portion formed from a second ceramic material and joined to said first core part, wherein said second ceramic material has at least one characteristic selected from the group consisting of thermal expansion coefficient, leachability, flowability and reactivity with the casting metal, which selected characteristic is different from than that of said first ceramic material.

14. The composite casting core as in claim 13, wherein the product is a hollow, gas-cooled gas engine turbine blade having a trailing edge portion and a body portion, and wherein said first core part is determinative of the cavity size and shape of said trailing edge portion, and the second core part is determinative of the cavity size and shape of said body portion.

15. The composite casting core as in claim 13, wherein said first ceramic material is predominantly silica, and wherein said second ceramic material is predominantly alumina.

16. The composite casting core as in claim 13, wherein each of said first core part and said second core part has at least one through-hole having a corresponding axis, and wherein the axes of said respective through-holes are nonparallel.

17. The composite casting core as in claim 13, wherein said joined first core part and said second core part are sintered.

18. The composite casting core as in claim 13, further including complementary interlocking means for mechanically joining said first core part and said second core part.

19. The composite casting core as in claim 18, wherein said first core part and said second core part have respective surfaces at which the parts are joined, and wherein a tongue and a complementary groove are provided on said respective joining surfaces.

20. Composite casting core for a hollow product having a portion with a small cavity size relative to that of another product portion, the core comprising:

a first core part determinative of the cavity size and shape of the small cavity product portion and formed from a first ceramic material;

a second core part determinative of the cavity size and shape of the other product portion, formed from a second ceramic material; and means for mechanically Joining said first and second core parts, wherein the product is a hollow, gas-cooled gas engine turbine blade having a trailing edge portion and a body portion, and wherein said first core part is determinative of the cavity size and shape of said trailing edge portion, and the second core part is determinative of the cavity size and shape of said body portion.

21. The composite casting core as in claim 20, wherein both the first and second ceramic materials are alumina-yttria-based ceramic materials.

22. The composite casting core as in claim 20, wherein the first and second ceramic materials have essentially the same characteristic grain size.

23. The composite casting core as in claim 20, wherein the first and second ceramic materials have essentially the same thermal characteristics.

24. The composite casting core as in claim 20 for use in a blade having a trailing edge slot wherein at least said trailing edge core part is formed by low-pressure injection molding, and wherein the thickness of the trailing edge core part corresponding to the slot provides a cast blade trailing edge slot thickness of about 0.015 inches or less.

25. The composite casting core as in claim 20, wherein each of said first core part and said second core part has at least one through-hole having a corresponding axis, and wherein the axes of said respective through-holes are nonparallel.

26. The composite casting core as in claim 20, wherein said mechanical joining means includes complementary interlocking members formed on the respective core parts.

27. The composite casting core as in claim 20, wherein said joined first core part and said second core part are sintered.

28. Method for forming a casting core for a hollow product having a portion with a small cavity size relative to that of another product portion, the method comprising the steps of:

a) forming a first core part determinative of the cavity size of the small cavity product portion from a first ceramic material having a characteristic grain size;

b) forming a second core part determinative of the cavity size of the other product portions from a second ceramic material having a characteristic grain size greater than that of the first ceramic material; and c) joining the first and second core parts to provide a composite casting core.

29. The method for forming a casting core as set forth in claim 28, wherein each of said first core part and said second core part are formed and joined as green bodies, and wherein the method includes the further step of sintering the joined first and second core parts.

30. The method for forming a casting core as in claim 28, wherein the first and second core parts are joined at respective joining surfaces, wherein said first core part forming step includes the step of forming one of a pair of complementary interlocking members on the joining surface associated with said first core part, and wherein said second core part forming step includes the step of forming the other of the pair of interlocking members on the joining surface associated with said second core part.

31. The method for forming a casting core as in claim 30, wherein said second core part: forming step includes the steps of inserting into a die a previously formed first core part including a first core part joining surface having said one interlocking member, flowing said second ceramic material into said die to contact and surround said first core part joining surface whereby said other interlocking member is formed concurrently with said second core part and whereby said first core part and said second core part are concurrently joined together.

32. The method for forming a casting core as in claim 30, wherein each of the first and second core parts has a through-hole and the axes of the respective through-holes are non-parallel, and wherein said second core part forming step includes using a "single pull" die.

33. Method for forming a casting core for a hollow gas turbine engine blade, the blade having a trailing edge portion with a small cavity size relative to that of the blade body portion, the method comprising the steps of:

a) forming a first core part determinative of the cavity size and shape of the trailing edge portion from a first ceramic material;

b) forming a second core part determinative of the cavity size of the body portion from a second ceramic material; and c) mechanically joining the first and second core parts to provide a composite casting core.

34. The method for forming a gas turbine engine blade casting core as set forth in claim 33, wherein each of said trailing edge core part and said body core part are formed and joined as green bodies, and wherein the method includes the further step of sintering the joined first and second core parts.

35. The method for forming a gas turbine engine blade casting core as in claim 33, wherein the trailing edge and body core parts are joined at respective joining surfaces, wherein said trailing edge core part forming step includes the step of forming one of a pair of complementary interlocking members on the joining surface associated with said trailing edge core part, and wherein said body core part forming step includes the step of forming the other complementary interlocking member on the joining surface associated with said body core part.

36. The method for forming a gas turbine engine blade casting core as in claim 35, wherein said second core part forming step includes the steps of inserting into a die a previously formed first core part including a first core part joining surface having said one interlocking member, flowing said second ceramic material into said die to contact and surround said first core part joining surface whereby said other interlocking member is formed concurrently with said second core part and whereby said first core part and said second core part are concurrently joined together.

37. The method for forming a casting core as in claim 35 wherein each of the first and second core parts has a through-hole and the axes of the respective through-holes are non-parallel, and wherein said second core part forming step includes using a "single pull" die.

38. The method for forming a gas turbine engine blade casting core as in claim 33, wherein said first and second ceramic materials are substantially the same, and wherein the first core part forming step and the second core part forming step are accomplished by injection molding.

39. The method for forming a gas turbine engine blade casting core as in claim 38, wherein a thermoplastic binder is added to the first and second core materials, and wherein the mechanical Joining step includes the step of heat bonding the first and second core parts using the thermoplastic binder.

40. The method for forming a gas turbine engine blade casting core as in claim 39, wherein said second core part forming step and said heat bonding step are carried out concurrently.

* * * * *

UNITED STATES PATENT AND TRADEMARK OFFICE

CERTIFICATE OF CORRECTION

PATENT NO. : 5,394,932

DATED : March 7, 1995

INVENTOR(S) : Carozza et al.

It is certified that error appears in the above-identified patent and that said Letters Patent is hereby corrected as shown below:

Claim 2, column 12, line 49, change "nonparallel" to --non-parallel--.

Claim 11, column 13, line 17, change "2" to --6--.

Claim 12, column 13, line 22, change "2" to --6--.

Claim 13, column 13, line 33, delete ":".

Claim 16, column 13, line 59, change "nonparallel" to --non-parallel--.

Claim 20, column 14, line 13, change "Joining" to --joining--.

Claim 25, column 14, line 43, change "nonparallel" to --non-parallel--.

Claim 31, column 15, line 14, delete ":".

Claim 32, column 15, line 25, change "30" to --31--.

Claim 37, column 16, line 26, change "35" to --36--.

UNITED STATES PATENT AND TRADEMARK OFFICE

CERTIFICATE OF CORRECTION

PATENT NO. : 5,394,932

DATED : March 7, 1995

INVENTOR(S) : Carozza et al.

It is certified that error appears in the above-indentified patent and that said Letters Patent is hereby corrected as shown below:

Column 16, line 39, change "Joining" to --joining--.

Signed and Sealed this

Ninth Day of July, 1996

*Attest:*

Bruce Lehman

BRUCE LEHMAN

*Attesting Officer*

*Commissioner of Patents and Trademarks*